United States Patent [19]

Kuhn et al.

[11] Patent Number: 4,948,275

[45] Date of Patent: Aug. 14, 1990

[54] RIBBON RE-INKING DEVICE

[75] Inventors: Mattheus W. J. Kuhn, Randburg; Douglas A. Schoeman, Johannesburg; Stephanus J. Le Roux, Aerorand, all of South Africa

[73] Assignee: Technical Systems Engineering CC, South Africa

[21] Appl. No.: 344,227

[22] Filed: Apr. 27, 1989

[30] Foreign Application Priority Data

Apr. 28, 1988 [ZA] South Africa ..... 88/3048
Oct. 4, 1988 [ZA] South Africa ..... 88/7440

[51] Int. Cl.[5] ..... B41J 31/14
[52] U.S. Cl. ..... 400/200; 400/197
[58] Field of Search ..... 400/197, 198, 200, 201, 400/202, 202.2, 202.3, 202.1, 199, 202.4; 101/367, 365; 118/672, 676, 679, 682; 222/163, 168.5

[56] References Cited

U.S. PATENT DOCUMENTS 4,126,715 11/1978 Schiffmacher et al. ..... 427/121
4,340,313 7/1982 Bishop ..... 400/202.1

FOREIGN PATENT DOCUMENTS 3435082 9/1984 Fed. Rep. of Germany ... 400/202.3
873467 5/1987 South Africa .

OTHER PUBLICATIONS

1971 Spring/Summer Catalog–Sears, p. 671.

*Primary Examiner*—Edgar S. Burr
*Assistant Examiner*—Joseph R. Keating
*Attorney, Agent, or Firm*—Brumbaugh, Graves, Donohue & Raymond

[57] ABSTRACT

A ribbon re-inking device includes an ink reservoir having at least one outlet for dispensing ink therefrom and a drive operable to displace a ribbon past the outlet of the reservoir, thereby to permit the ink to be dispensed from the reservoir and applied to the ribbon. The reservoir is displaceable between an inoperative position wherein release of ink via the reservoir outlet is prevented, and at least one static operative dispensing position. The drive is controllably energizable to cause displacement of the ribbon past the reservoir outlet upon displacement of the reservoir to its operative dispensing position.

11 Claims, 4 Drawing Sheets

RIBBON RE-INKING DEVICE

This invention relates to a ribbon re-inking device, particularly for re-inking a printer ribbon incorporated in a portable cassette or on a spool.

According to the invention there is provided a ribbon re-inking device which includes a reservoir for containing ink, the reservoir having at least one outlet for dispensing ink from the reservoir, and drive means operable to displace a ribbon past the outlet of the reservoir thereby to permit the ink to be dispensed from the reservoir and applied to the ribbon, the reservoir being displaceable between an inoperative position wherein release of ink via the reservoir outlet is prevented, and at least one static operative dispensing position, the drive means being controllably energizable to cause displacement of the ribbon past the reservoir outlet upon displacement of the reservoir to its operative dispensing position.

The reservoir may have a plurality of circumferentially spaced outlets defined in its periphery and the reservoir may be rotatably mounted on a support formation to permit various of the outlets to be brought into operative dispensing relationship with the ribbon by selectively rotating the reservoir to different static dispensing positions. Sets of aligned outlets may then be provided at each dispensing position. Locking means may be provided for locking the reservoir in any one of its operative dispensing positions. The reservoir may be removably mounted on the support formation to permit a variety of different reservoirs to be used corresponding to different types of ribbons.

The device may also include detection means for detecting when the reservoir is in its operative dispensing position, the detection means being operable to energize the drive means. The detection means may include a lever, e.g. the lever of a micro-switch, cooperating with a cam provided on a portion of the reservoir, the cam being operable to displace the lever when the reservoir is rotated to an operative dispensing position or when it is moved from its inoperative position. The detection means may also be arranged to energize indicator means, e.g. a visual or audible alarm such as a pilot light or buzzer, when the reservoir is in its operative dispensing position.

The peripheral face of the reservoir in which the outlet is provided may be smoothly arcuately curved. The reservoir may be in the form of a trough, a cylinder, or the like.

The device may include guide means for guiding the ribbon during re-inking. The guide means may include a guide formation such as a flange or lug provided on the reservoir and operable to guide the ribbon against lateral displacement relative to the reservoir. The guide means may further include a plurality of pins arranged in spaced relationship relative to the reservoir, e.g. provided on the support formation, and arranged to guide travel of the ribbon past the outlet and to keep the ribbon in close contact with the reservoir outlet. The pins may be removably locatable relative to the reservoir to permit variation of the positioning of the pins relative to the reservoir again to cater for various types of ribbon.

The drive means may include an electric motor. When used for re-inking a ribbon contained on a pair of spools rather than a continuous ribbon contained in a cassette, switch means may be provided operable to control the direction of rotation of the motor. The drive means may further include a drive formation which is removably connected to the drive means to permit various drive formations drivably to be used in conjunction with various type of ribbons.

The device may further include a timing device which is activated when the drive means is energized, the timing device being operable to trigger a signal, e.g. an audible or visible signal, after the drive means has been energized for a selected time interval. The timing device may include adjustment means whereby the duration of the selected time interval is adjustable.

The device may include attachment means, e.g. in the form of at least one strip having faces bearing complementary releasably engageable formations, whereby a cassette containing the ribbon to which ink is to be applied is releasably mountable on the support formation of the device.

Various embodiments of the invention are now described by way of example with reference to the accompanying drawings, in which FIG. 1 shows a front view of a ribbon re-inking device substantially in accordance with the invention;

Figure 1:
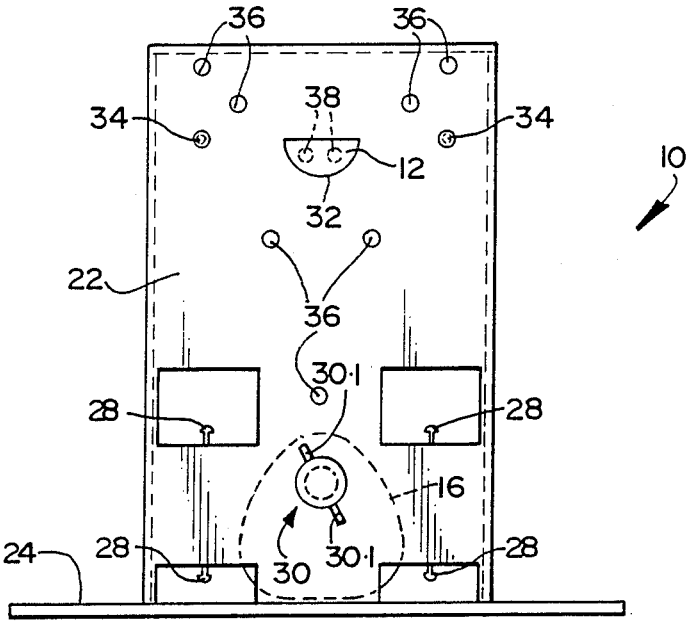
Figure 2:
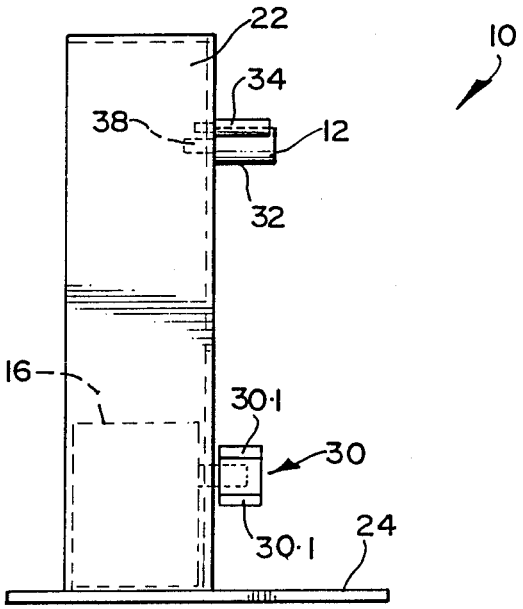
FIGS. 2, 3 and 4 show respectively a side elevation, plan view and three dimensional view of the device of FIG. 1.
Figure 3:
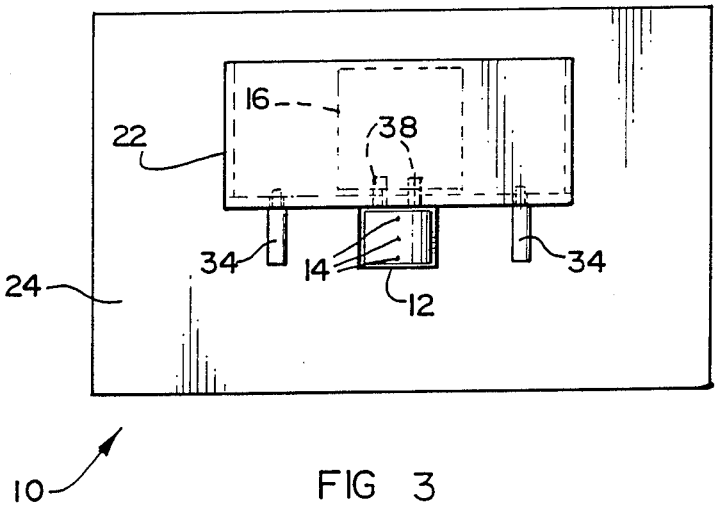

Referring to the drawings, reference numeral 10 generally indicates a ribbon re-inking device which includes a reservoir 12 for containing ink and having in the FIGS. 1 to 4 embodiment, a set of three outlets 14 (shown more clearly in FIG. 3) for dispensing ink from the reservoir 12. The outlets 14 conveniently each have a diameter of about 0.9 mm and are arranged equally spaced over a width of about 15 mm. The device also includes drive means in the form of an electric motor 16 operable to displace a ribbon 18 contained in a cassette 20 past the outlets 14.

The reservoir 12 is mounted on the front face of a support formation 22 which itself is mounted on a base 24. The motor 16 is housed within the support formation 22.

Figure 4:
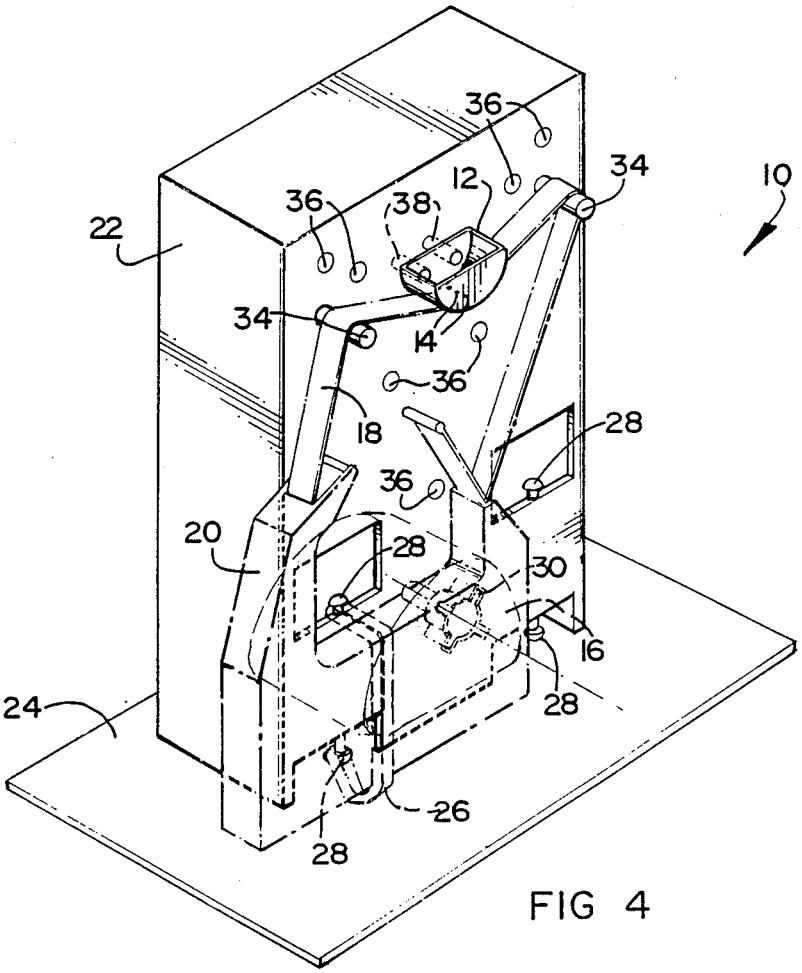

In the FIG. 4 embodiment, the cassette 20 is attached in position by simply spanning an elastic band 26 between support posts 28 provided at various positions on the support formation 22 to cater for various types of ribbons and cassettes. Drive from the motor 16 to the cassette 20 is effected by a drive formation 30 which is a frictional fit and removably mounted on a drive shaft of the motor 16 again to cater for various types of ribbons and cassettes. The drive formation 30 has a central hub and a pair of radial flanges as best seen in FIG. 1.

The operative inking face 32 of the reservoir 12 is arcuately curved and the ribbon 18 is kept in close contact with the face 32 of the reservoir 12 by guide pins 34. The guide pins 34 are removably locatable in a variety of apertures 36 again to cater for various types of ribbons and cassettes.

The reservoir 12 is also removably locatable on the support formation 22 by spigots 38 located as an interference fit in complementary sockets in the support formation 22. This allows various types of reservoir having different numbers of outlets 14 and having different widths to be replaceably located on the support formation 22 to cater for various types of ribbons.

Figure 5:
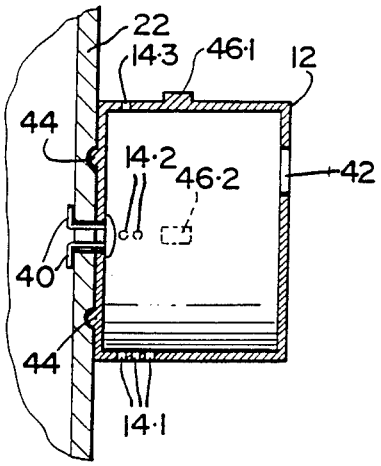
FIG. 5 shows a sectional side view of a modified form of reservoir which is preferably used in place of the reservoir shown in the device of FIGS. 1 to 4.

The reservoir 12 shown in the FIGS. 1 to 4 embodiment is non-rotatably fixed in position. In FIG. 5, a modification is shown where the reservoir 12 is in the form of a circular cylinder and which has three static dispensing positions. In the position illustrated in FIG. 5, ink is dispensed via three outlets 14.1. If the reservoir 12 is rotated through 90°, the reservoir is in a second dispensing position with the outlets 14.2 forming the dispensing outlets. If the reservoir 12 is rotated through a further 90°, a third dispensing position is provided in which ink is dispensed from a single outlet 14.3. If the reservoir 12 is rotated through a further 90°, it is in an inoperative position with the outlets 14.1 and 14.3 facing horizontally and the outlets 14.2 facing vertically upwardly. Each of the outlets has a diameter of 0,9 mm.

The reservoir 12 is rotatably mounted by means of resilient pins 40 on the support formation 22 which again permit replacement of the reservoir 12 with a different form of reservoir. Ink is introduced into the reservoir via a port 42. The reservoir 12 has locking means in the form of dimples 44 which engage complementary recesses provided at suitable positions in the front face of the support formation 22. Guide lugs 46.1 and 46.2 are provided for preventing lateral displacement of the ribbon during inking. The guide lugs 46.1 and 46.2 are used for 6 mm and 12 mm ribbons respectively.

Figure 6:
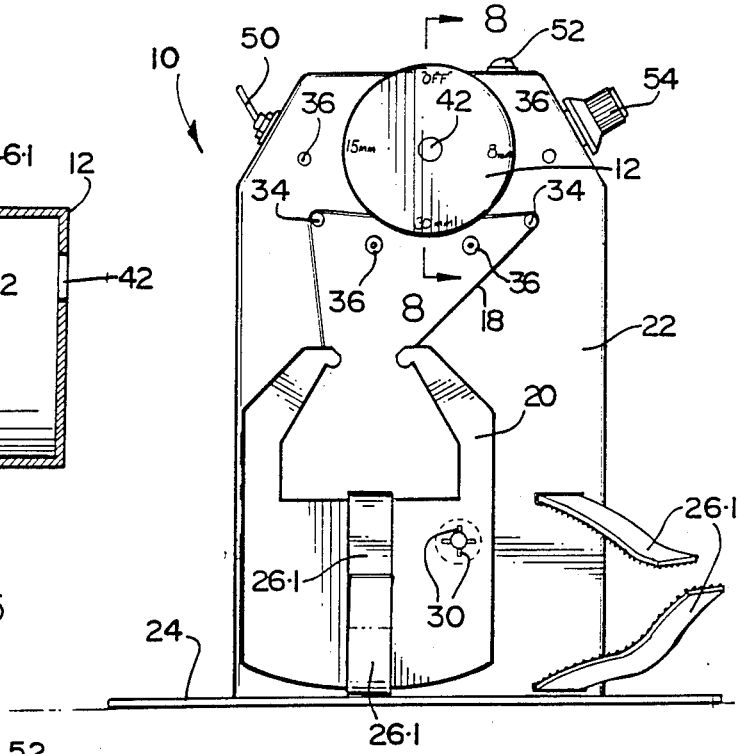
FIG. 6 shows a front elevation of a further form of ribbon re-inking device in accordance with the invention.
Figure 7:
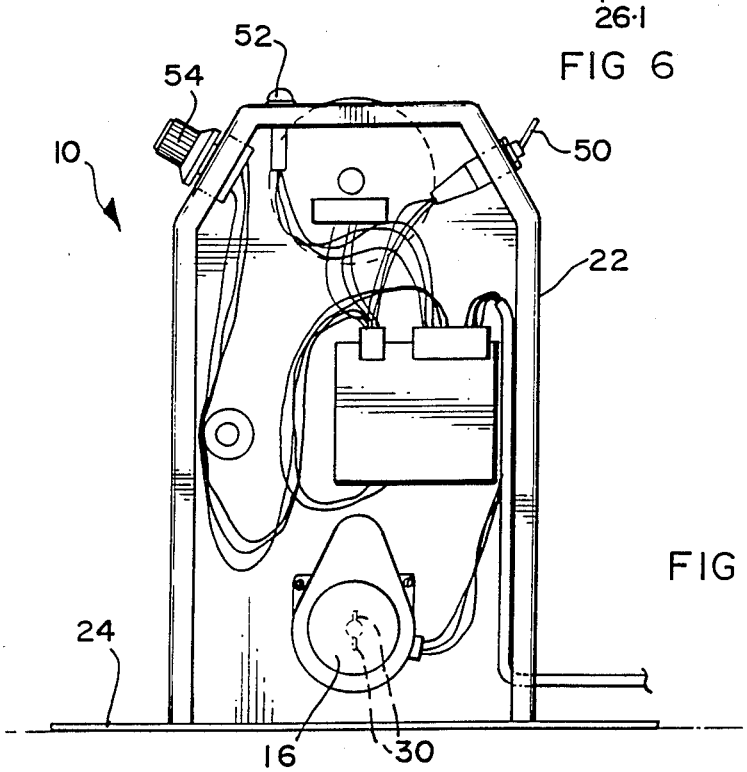
FIG. 7 shows a rear view of the device of FIG. 6.

A modification of the device is shown in FIGS. 6 and 7 and in view of the similarities with the previous embodiment, similar reference numerals have been used. Minor modifications have been made particularly in that instead of an elastic band 26, the cassette 20 is attached to the support formation 20 by one of two pairs of straps 26.1 having releasable engagement formations thereon known in the trade as Velcro for ready attachment of the cassette 20. The reservoir 12 is similar to that shown in the FIG. 5 embodiment and is shown in FIG. 6 in its inoperative position with suitable markings on the front face of the reservoir indicating the width of the ribbon to which the reservoir 12 is to be rotated when different widths of ribbon are used. The pins 34 are now in the form of rollers of high density polyethylene rotatably mounted on brass shanks which are screw-threadedly receivable in various apertures 36.

The motor 16 is energized via a switch 50 which can be used to control the direction of rotation of the motor if the ribbon to be re-inked is on a pair of spools or is a reversible ribbon rather than the continuous ribbon normally provided in a cassette. When the reservoir 12 is rotated to one of its operative positions, an indicator light 52 is illuminated. The device also includes timing means which is adjustable via a knob 54. The timing means is used to warn an operator, after energization of the drive means, that an adjustable time period has passed and that a re-inking cycle has been completed by triggering a buzzer (not shown in FIGS. 6 to 8) or by extinguishing the light 52. Instead, the light 52 may be illuminated only upon completion of the re-inking cycle. Also the timing means may be arranged to control the duration for which the motor runs in each cycle although this may result in an over supply of ink to a localized area on the ribbon when the motor stops.

Figure 8:
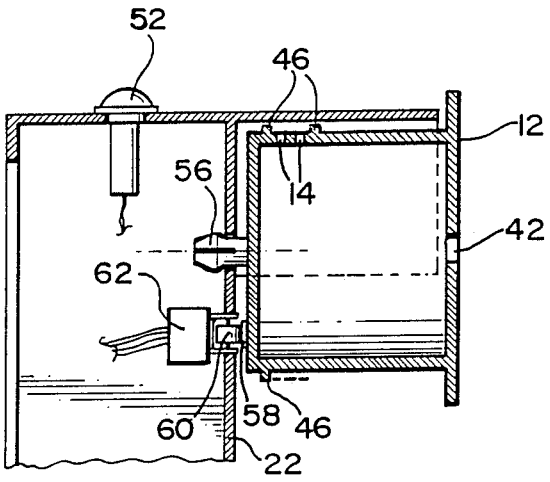
FIG. 8 shows a sectional side view of the reservoir used in the device of FIGS. 6 and 7.

As shown in FIG. 8, the reservoir 12 is removably located in the support formation 22 by a resiliently deformable spigot 56 which is a force fit in the support formation 22. Also, operation of the motor 16 is prevented while the reservoir is in its inoperative position by a cam 58 which co-operates with a lever 60 of a micro-switch 62. As soon as the reservoir 12 is rotated away from its inoperative position, the micro-switch 62 is activated to allow energization of the motor 16.

Figure 9:
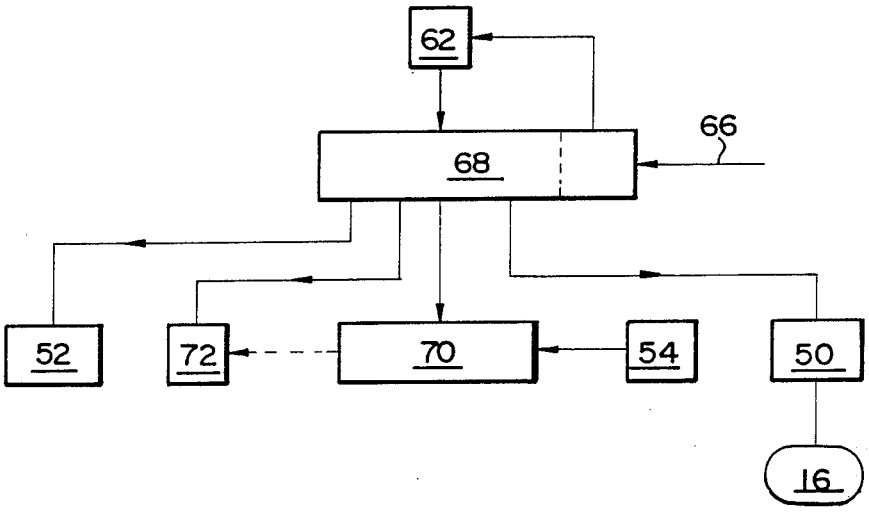
FIG. 9 shows a schematic block diagram of the control circuitry used in the device of FIGS. 6 and 7.

Referring to FIG. 9, a block schematic diagram of the device is shown. An electrical supply is applied to the device via line 66 to a controller 68. The controller is fed with an input signal from the micro-switch 62 when the reservoir 12 is rotated from its inoperative position. When so rotated, the indicator light 52 is illuminated and the motor 16 is energized via the switch 50 which optionally controls the direction of rotation of the motor 16. Also, at the beginning of each cycle, a timer 70 is initiated and dependent upon the setting of the adjustment knob 54, will after an adjustable pre-selected period, trigger a buzzer 72 to indicate that the cycle is finished. The motor 16 is then de-energized by rotating the reservoir 12 back to its inoperative position.

In use, a ribbon contained in a cassette or on a spool is attached to the device and ink contained in the reservoir 12 can then be dispensed onto the ribbon by displacing the reservoir 12 to one of its operative dispensing positions. If necessary, the switch 50 can be switched at the end of a cycle to reverse the direction of the motor 16 and a further cycle initiated. In the case of a continuous ribbon, at the end of a cycle an audible or visual signal is given after an adjustable preselected period. If necessary, the cycle can be re-initiated by returning the reservoir to its inoperative position and then displacing it to one of its operative dispensing positions. If desired, at the end of the re-inking cycle, the drive means can be arranged automatically to rotate the reservoir back to its inoperative position.

The invention illustrated provides a ribbon re-inking device which is of simple construction yet which can effectively be used to re-ink a wide variety of different types of ribbons. Unlike prior similar devices of which the applicant is aware in which the reservoir is rotated to dispense the ink, in the embodiments illustrated, the reservoir is static during dispensing thereby minimizing the risk of unwanted ink being dispensed in a messy fashion. Accordingly, the reservoir 12 can be used to store ink therein even when the device is not in use. The re-inking cycle is readily initiated by simply rotating the reservoir to one of its operative dispensing positions.

What we claim is:

1. A ribbon re-inking device comprising a support, an ink reservoir having at least one dispensing outlet adapted to conduct ink from the reservoir and apply it to a ribbon to be re-inked, drive means for displacing a ribbon past the dispensing outlet of the ink reservoir thereby to permit the ink to be dispensed from the ink reservoir via the dispensing outlet and applied to the ribbon, means for mounting the ink reservoir on the support for displacement between an inoperative position wherein release of ink via the dispensing outlet is prevented, and at least one static operative dispensing position, and detection means operable to detect when the ink reservoir is in its operative dispensing position, the drive means being responsive to the detection means and the detection means being operable to energize the drive means to cause displacement of the ribbon past the dispensing outlet upon displacement of the ink reservoir to its operative dispensing position, the detection means including a lever on the support and a cam provided on a portion of the ink reservoir, the cam cooperating with the lever and being operable to displace the lever when the ink reservoir is rotated.

2. A ribbon re-inking device comprising a support, an ink reservoir adapted to contain ink and having at least one dispensing outlet adapted to conduct ink from the reservoir and apply it to a ribbon to be re-inked, means for mounting the ink reservoir on the support for movement between an inoperative position in which dispensing of ink through the dispensing outlet is prevented and an operative dispensing position in which dispensing of the ink through the dispensing outlet and application to the ribbon are enabled, means for guiding the ribbon along a path adjacent the reservoir, drive means for moving the ribbon along the path and including an electric motor, and means for energizing the electric motor in response to movement of the ink reservoir to the operative dispensing position.

3. A device as claimed in claim 2, in which the reservoir has a multiplicity of circumferentially spaced dispensing outlets defined in its periphery and in which the mounting means mounts the reservoir rotatably on the support to permit each of the outlets to be brought into an operative dispensing position by rotating the reservoir.

4. A device as claimed in claim 3, in which the mounting means includes means for removably mounting each of a multiplicity of interchangeable reservoirs on the support to permit a variety of different reservoirs to be used corresponding to different types and sizes of ribbons.

5. A device as claimed in claim 3, in which the mounting means includes locking means for locking the reservoir selectively in each of its operative dispensing positions on the support.

6. A device as claimed in claim 3, in which the energizing means includes detection means having a lever on the support cooperating with a cam provided on a portion of the reservoir, the cam being operable to displace the lever when the reservoir is rotated to the operative dispensing position.

7. A device as claimed in claim 6, and further comprising indicator means responsive to the detection means and operable to generate a sensory indication of when the reservoir is in its operative dispensing position.

8. A device as claimed in claim 2, in which the guide means includes a guide formation provided on an outer periphery of the reservoir and operable to guide the ribbon against lateral displacement relative to the reservoir.

9. A device as claimed in claim 2, in which the guide means includes a plurality of guide pins on the support arranged in spaced relationship relative to the reservoir and arranged to guide travel of the ribbon past the outlet and to keep the ribbon in close contact with the outlet, the pins being removably locatable relative to the reservoir to permit variation of the positioning of the pins relative to the reservoir.

10. A device as claimed in claim 2, in which the drive means includes a multiplicity of interchangeable output members, each of which is adapted to be removably connected to the electric motor to permit various output members to be selectively used in conjunction with various types and sizes of ribbons.

11. A device as claimed in claim 2, and further comprising timing means for generating a termination signal after the electric motor has been energized for a selected time interval, and adjustment means for varying such time interval.

* * * * *